US006447258B2

(12) United States Patent
Ota et al.

(10) Patent No.: US 6,447,258 B2
(45) Date of Patent: Sep. 10, 2002

(54) CONTROL VALVE FOR VARIABLE DISPLACEMENT COMPRESSOR

(75) Inventors: Masaki Ota; Kazuya Kimura; Masahiro Kawaguchi; Ken Suitou; Ryo Matsubara; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/816,635

(22) Filed: Mar. 23, 2001

(30) Foreign Application Priority Data

Mar. 30, 2000 (JP) ..... 2000-094006

(51) Int. Cl.[7] ..... F04B 1/26; B67D 5/08
(52) U.S. Cl. ..... 417/222.2; 137/565.16
(58) Field of Search ..... 417/222.2; 137/565.16, 137/487.5

(56) References Cited

U.S. PATENT DOCUMENTS 4,890,458 A * 1/1990 Kobayashi et al. ..... 417/222.2
5,017,096 A * 5/1991 Sugiura et al. ..... 417/222.2
5,205,718 A * 4/1993 Fujisawa et al. ..... 417/222.2
5,486,098 A * 1/1996 Kimura et al. ..... 417/222.2
6,010,312 A * 1/2000 Suitou et al. ..... 417/222.2
6,102,668 A 8/2000 Kawaguchi et al. ..... 417/222.2

FOREIGN PATENT DOCUMENTS

JP 10-318155 12/1998 ..... F04B/49/06

* cited by examiner

*Primary Examiner*—Charles G. Freay
*Assistant Examiner*—Timothy P. Solak
(74) *Attorney, Agent, or Firm*—Morgan & Finnegan, LLP

(57) ABSTRACT

A valve body adjusts opening of a supply passage in response to the position in a valve chamber. A pressure-sensitive member is moved in accordance with the pressure difference between two pressure monitoring points, which are located in an external refrigerant circuit. The movement of the pressure-sensitive member affects the position of the valve body such that the compressor displacement is changed to reduce fluctuations in the pressure difference. A solenoid changes force applied to the valve body so that a set pressure difference, which is a reference value for changing the position of the valve body by the pressure-sensitive member, is changed.

10 Claims, 6 Drawing Sheets

CONTROL VALVE FOR VARIABLE DISPLACEMENT COMPRESSOR

BACKGROUND OF THE INVENTION

The present invention relates to a control valve used in a variable displacement compressor that forms a refrigerant circulation circuit in a vehicle air conditioner, and the displacement of which is variable on the basis of the pressure of the crank chamber.

In general, the refrigerant circulation circuit of a vehicle air conditioner includes a condenser, an expansion valve, which serves as a decompression device, an evaporator and a compressor. The compressor draws and compresses refrigerant from the evaporator, and discharges compressed gas to the condenser. The evaporator transfers heat to the refrigerant from the air in the vehicle. Because the heat of the air passing by the evaporator is transferred to the refrigerant flowing in the evaporator according to the magnitude of the thermal load, or the cooling load, the cooling gas pressure at the exit or downstream of the evaporator reflects the magnitude of the cooling load.

In a typical vehicle variable displacement swash plate type compressor, there is a displacement control mechanism to maintain the exit pressure of the evaporator (called the suction pressure) at a prescribed target value (called the set suction pressure). The displacement control mechanism uses feedback control to control the displacement of the compressor, i.e., the swash plate angle, and the suction pressure is a control indicator to achieve a refrigerant flow rate that meets the demand for cooling.

A typical example of the aforementioned displacement control mechanism is a control valve known as an inner control valve. The swash plate angle is determined through adjustment of the pressure (crank pressure) of the swash plate chamber (known also as the crank chamber) by sensing the suction pressure with a pressure-sensitive member such as bellows or a diaphragm, and adjusting the degree of valve opening by using of the displacement of the pressure-sensitive member for positioning the valve body.

There is a simple inner control valve that can have only a single set suction pressure and cannot finely control air conditioning control. This valve is known as a set suction pressure variable type control valve and is capable of changing the set suction pressure by electric control. The set suction pressure variable type control valve changes the set suction pressure by, for example, adding an actuator for applying a variable force to the inner control valve and thus changing (increasing or decreasing) a force acting on the pressure-sensitive member. This determines the set suction pressure of the inner control valve externally. The actuator may be, for example, an electromagnetic solenoid.

In the displacement control using an absolute value of the suction pressure as an indicator, however, a change in the set suction pressure by electric control does not necessarily change the actual suction pressure to the set suction pressure. That is, whether or not the actual suction pressure responsively follows a change in the setting of the set suction pressure is affected by the thermal load condition in the evaporator. As a result, although electric control finely adjusts the set suction pressure, the change in the displacement of the compressor tends is delayed. That is, the displacement does not always change continuously and smoothly.

SUMMARY OF THE INVENTION

It is an object of the present invention to provide a control valve for a variable displacement compressor that permits improvement of controllability or response of the displacement.

To achieve the foregoing and other objectives and in accordance with the purpose of the present invention, a control valve used in a variable displacement compressor is provided. The compressor draws refrigerant from an external refrigerant circuit, compresses the refrigerant and then discharges the compressed refrigerant to the external refrigerant circuit. A zone that is exposed to suction pressure is connected to a crank chamber by a bleeding passage, and a zone that is exposed to discharge pressure is connected to the crank chamber by a supply passage, thereby adjusting the pressure in the crank chamber. The displacement of the compressor is varied based on the pressure in the crank chamber. The control valve includes a valve housing, a valve chamber, a valve body, a first limiting member, a first urging member, a pressure-sensitive member, first and second pressure monitoring points, a second limiting member, a second urging member and a control member. The valve chamber is defined in the valve housing and forms a part of the supply passage or the bleeding passage. The valve body is accommodated in the valve chamber and is moved in the valve chamber to adjust the degree of opening of the supply passage or the bleeding passage. When contacting the valve body, the first limiting member limits the movement of the valve body. The first urging member urges the valve body toward the first limiting member. The pressure-sensitive chamber is defined in the valve housing. The pressure-sensitive member is movably arranged in the pressure-sensitive chamber and divides the pressure-sensitive chamber into a first pressure chamber and a second pressure chamber. The pressure-sensitive member is moved based on the pressures in the first and second pressure chambers. The pressure-sensitive member selectively separates from and engages with the valve body. The first and second pressure monitoring points are located in the external refrigerant circuit. The pressure difference between the two pressure monitoring points represents the compressor displacement. The first pressure monitoring point is located in a higher pressure zone and the second pressure monitoring point is located in a lower pressure zone. The first pressure chamber is exposed to the pressure at the first pressure monitoring point and the second pressure chamber is exposed to the pressure at the second pressure monitoring point. When the pressure-sensitive member is moved based on the pressure difference between the first and second pressure chambers, the movement of the pressure-sensitive member affects the position of the valve body such that the compressor displacement is changed to reduce fluctuations in the pressure difference between the first and second pressure chambers. When contacting the pressure-sensitive member, the second limiting member limits the movement of the pressure-sensitive member. The second urging member urges the pressure-sensitive member toward the second limiting member. The control member urges the valve body against the forces of the first and second urging members such that the valve body contacts the pressure-sensitive member. The force applied to the valve body is externally controlled so that a set pressure difference, which is a reference value for determining the position of the valve body by the pressure-sensitive member, is changed.

Other aspect and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENT

The control valve for a variable displacement swash plate type compressor for circulating refrigerant in a vehicle air conditioner will be described with reference to FIGS. 1 to 6.

(Variable Displacement Swash Plate Type Compressor)

Figure 1:
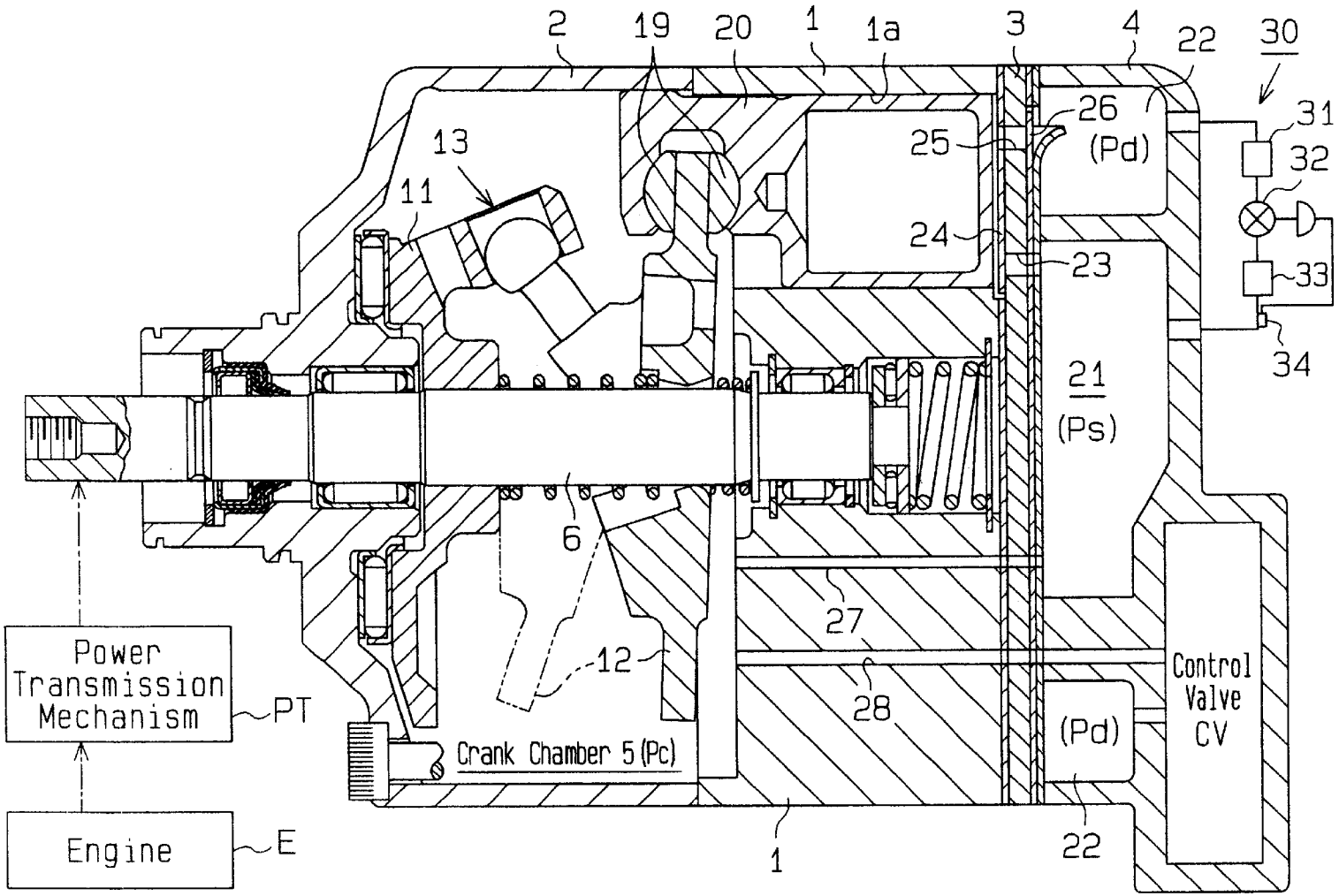
Fig.1 (Prior Art)
FIG. 1 is a sectional view of a variable displacement swash plate type compressor.

As shown in FIG. 1, the variable displacement swash plate type compressor (hereinafter simply referred to as the compressor) includes a cylinder block 1, a front housing 2, which is fastened to the front end of the cylinder block 1, and a rear housing 4, which is fastened to the rear end of the cylinder block 1 with a valve forming body 3.

A crank chamber 5 is surrounded by the cylinder block 1 and the front housing 2. A drive shaft 6 is supported in the crank chamber 5. In the crank chamber 5, a lug plate 11 is integrally and rotatably secured to the drive shaft 6.

The leading end of the drive shaft 6 is operably connected to an external drive source, which is a vehicle engine E in this embodiment by a known power transmission mechanism PT. The power transmission mechanism PT may be a clutch mechanism (for example, an electromagnetic clutch) permitting engagement or disengagement of power under external electric control or may be a constant transmitting clutchless mechanism (for example, a belt/pulley combination) In this embodiment, a clutchless type power transmission mechanism PT is being used.

A swash plate 12, or a cam plate, is accommodated in the crank chamber 5. The swash plate 12 is supported by the drive shaft 6 and is permitted to tilt and slide axially. A hinge mechanism 13 is provided between the lug plate 11 and the swash plate. Therefore, as a result of the hinge connection with the lug plate 11 and the support provided by the drive shaft 6, the swash plate 12 rotates in synchronization with the lug plate 11 and the drive shaft 6 and can incline relative to the axis of the drive shaft 6 while sliding in the axial direction of the drive shaft 6.

A plurality of cylinder bores 1*a* (only a single cylinder bore is shown) is provided and formed to surround the drive shaft 6 in the cylinder block 1. A single-head type piston 20 is reciprocally accommodated in each cylinder bore. The rear openings of the cylinder bores la are closed by the valve forming body 3, and in each cylinder bore 1*a*, there is a compression chamber, the volume of which changes in response to the reciprocation of the piston 20. Each piston 20 is coupled to the outer periphery of the swash plate 12 via a shoe 19. Therefore, the rotating motion of the swash plate 12 is converted to reciprocation of the pistons 20 by the shoes 19.

A suction chamber 21, which is positioned centrally and a discharge chamber 22, which surrounds the suction chamber 21, are formed between the valve forming body 3 and the rear housing 4. A suction port 23, a suction valve 24, which opens or closes the suction port 23, a discharge port 25 and a discharge valve 26, which opens and closes the discharge port 25, are formed on the valve forming body 3 in association with each bore 1*a*. The suction chamber 21 and the cylinder bores 1*a* communicate with each other via the suction port 23, and the cylinder bores 1*a* and the discharge chamber 22 communicated with each other via the discharge port 25.

Refrigerant from the suction chamber 21 is drawn into the cylinder bores 1*a* via the suction port 23 and the suction valve 24 by reciprocation of the pistons 20 between a top dead center position and a bottom dead center position. The refrigerant drawn into the cylinder bores 1*a* is compressed to a prescribed pressure by motion of the pistons from the bottom dead center to the top dead center and is discharged to the discharge chamber 22 via the discharge ports 25 and the discharge valves 26, respectively.

The inclination angle of the swash plate 12 (the angle to a plane perpendicular to the axis of the drive shaft 6) is determined on the basis of the mutual balance of various moments such as a moment of rotating motion caused by the centrifugal force during rotation of the swash plate 12, a moment based on the reciprocating inertia of the piston 20, and a moment based on the gas pressure. The moment based on gas pressure is a moment occurring on the basis of the relationship between the inner pressure of the cylinder bore 1*a* and the inner pressure (crank pressure Pc) of the crank chamber, which serves as a control pressure, and acts to increase or decrease the inclination angle depending on the crank pressure Pc.

In this compressor, it is possible to select an inclination angle of the swash plate 12 within a range between a minimum inclination angle (shown by a solid line in FIG. 1) and a maximum inclination angle (shown by a broken line in FIG. 1) by adjusting the crank pressure Pc with a control valve CV, which is described later, and thus changing the moment based on the gas pressure.

(Pressure Control Mechanism)

The crank pressure control mechanism for controlling the crank pressure Pc and the inclination control of the swash plate 12 includes a bleeding passage 27, a supply passage 28 and the control valve CV, which is provided in the compressor housing shown in FIG. 1. The bleeding passage 27 connects the suction chamber 21, which is in the suction pressure (Ps) area, to the crank chamber 5. The supply passage 28 connects the discharge chamber 22, which is in the discharge pressure (Pd) area to the crank chamber 5, and the control valve CV is located in the supply passage 28.

The balance between the flow rate of gas entering the crank chamber 5 via the supply passage 28 and the flow rate of gas exiting the crank chamber 5 via the bleeding passage 27 is controlled by adjusting the degree of opening of the control valve CV. Thus, the control valve CV determines the crank pressure Pc. The difference between the crank pressure Pc and the inner pressure of the cylinder bore 1*a* changes in response to a change in the crank pressure Pc, and the inclination angle of the swash plate 12 changes accordingly. As a result, the stroke of the piston 20, i.e., the displacement, is adjusted.

(Refrigerant Circulation Circuit)

Figure 2:
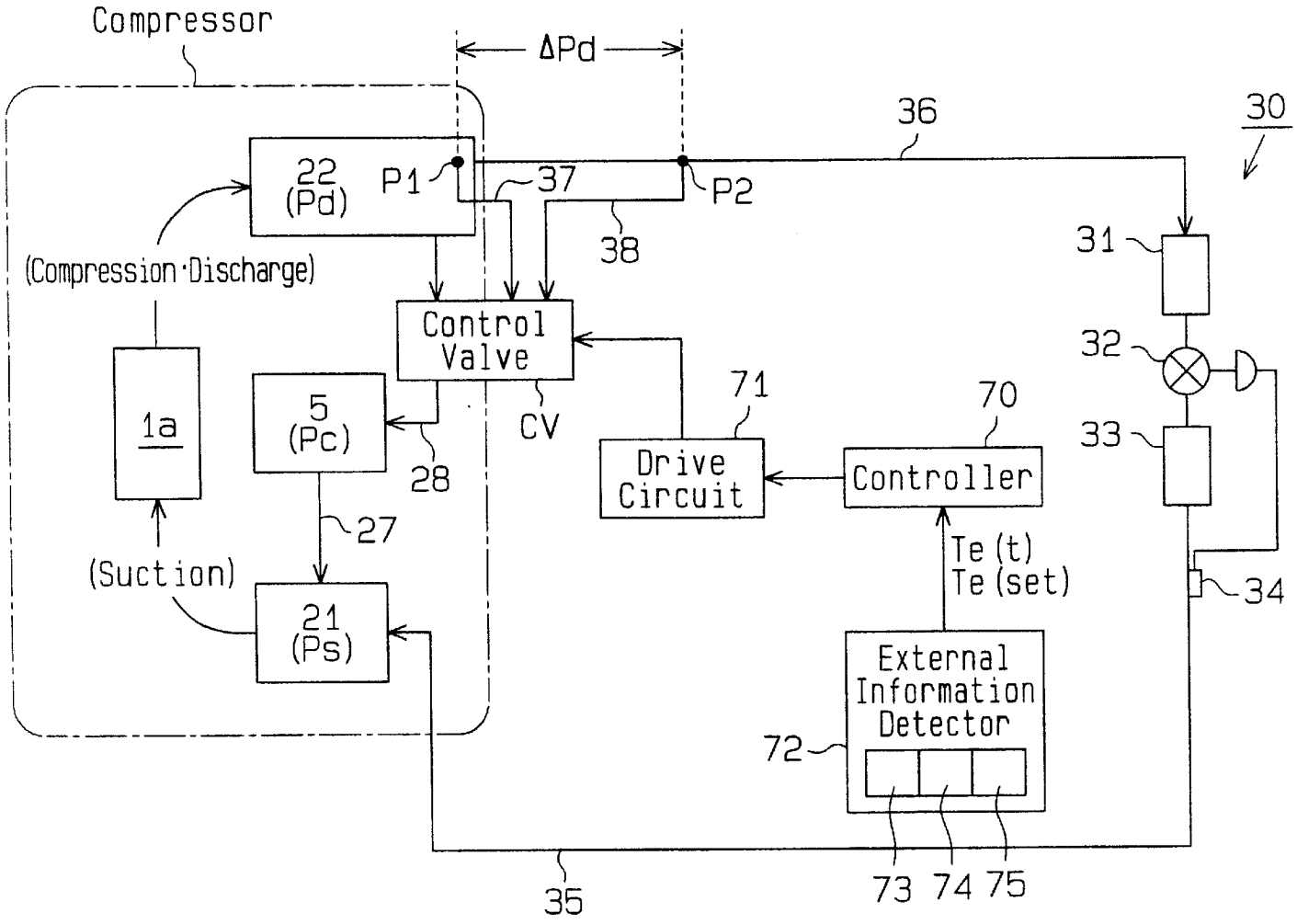
FIG. 2 is a circuit diagram illustrating a refrigeration circuit.

As shown in FIGS. 1 and 2, the refrigerant circulation circuit of the vehicle air conditioner (refrigerant circuit) includes the aforementioned compressor and an external refrigerant circuit 30. The external refrigerant circuit 30 includes, for example, a condenser 31, a temperature type expansion valve 32 serving as a decompression device, and an evaporator 33. The degree of opening of the expansion valve 32 is feedback-controlled on the basis of the temperature detected by a temperature sensitive cylinder 34, which is located at the exit side of or downstream of the evaporator 33, and the evaporation pressure (exit pressure of the evaporator 33). The expansion valve 32 regulates the flow of refrigerant, according to the thermal load, to the evaporator 33 and adjusts the refrigerant flow rate in the external refrigerant circuit 30.

Downstream of the external refrigerant circuit 30, there is a flow pipe 35 connecting the evaporator 33 exit to the suction chamber 21 of the compressor. Upstream of the external refrigerant circuit 30, there is a flow pipe 36 connecting the discharge chamber 22 of the compressor to the condenser 31 entrance. The compressor draws and compresses the refrigerant from the downstream area of the external refrigerant circuit 30 to the suction chamber 21 and discharges the compressed gas to the discharge chamber 22, which is connected to the upstream area of the external refrigerant circuit 30.

The pressure loss per unit length of a circuit or pipe increases as the flow rate of the refrigerant flowing through the refrigerant circulation circuit increases. In other words, the pressure loss (pressure difference) between two pressure monitoring points P1 and P2 in the refrigerant circulation circuit corrects with the refrigerant flow rate. Therefore, detecting the pressure difference between the two pressure monitoring points P1 and P2 ($\Delta Pd = PdH - PdL$) is indirectly detecting the refrigerant flow rate in the refrigerant circulation circuit. When the displacement of the compressor increases, the refrigerant flow rate in the refrigerant circulation circuit increases as well, and when the displacement decreases, the refrigerant flow rate also decreases. Therefore, the refrigerant flow rate in the refrigerant circulation circuit, i.e., the pressure difference $\Delta Pd$ between the two points, reflects the displacement of the compressor.

In this embodiment, the first pressure monitoring point P1 is located in the discharge chamber 22 at the most upstream part of the pipe 36, and the second pressure monitoring point P2 is located in the middle of the pipe 36 and spaced apart from the first point P1 by a prescribed distance. The gas pressure PdH at the first pressure monitoring point P1 is applied through a first pressure detecting passage 37, and the gas pressure PdL at the second point P2 is applied through a second pressure detecting passage 38 to the control valve CV.

(Control Valve)

Figure 3:
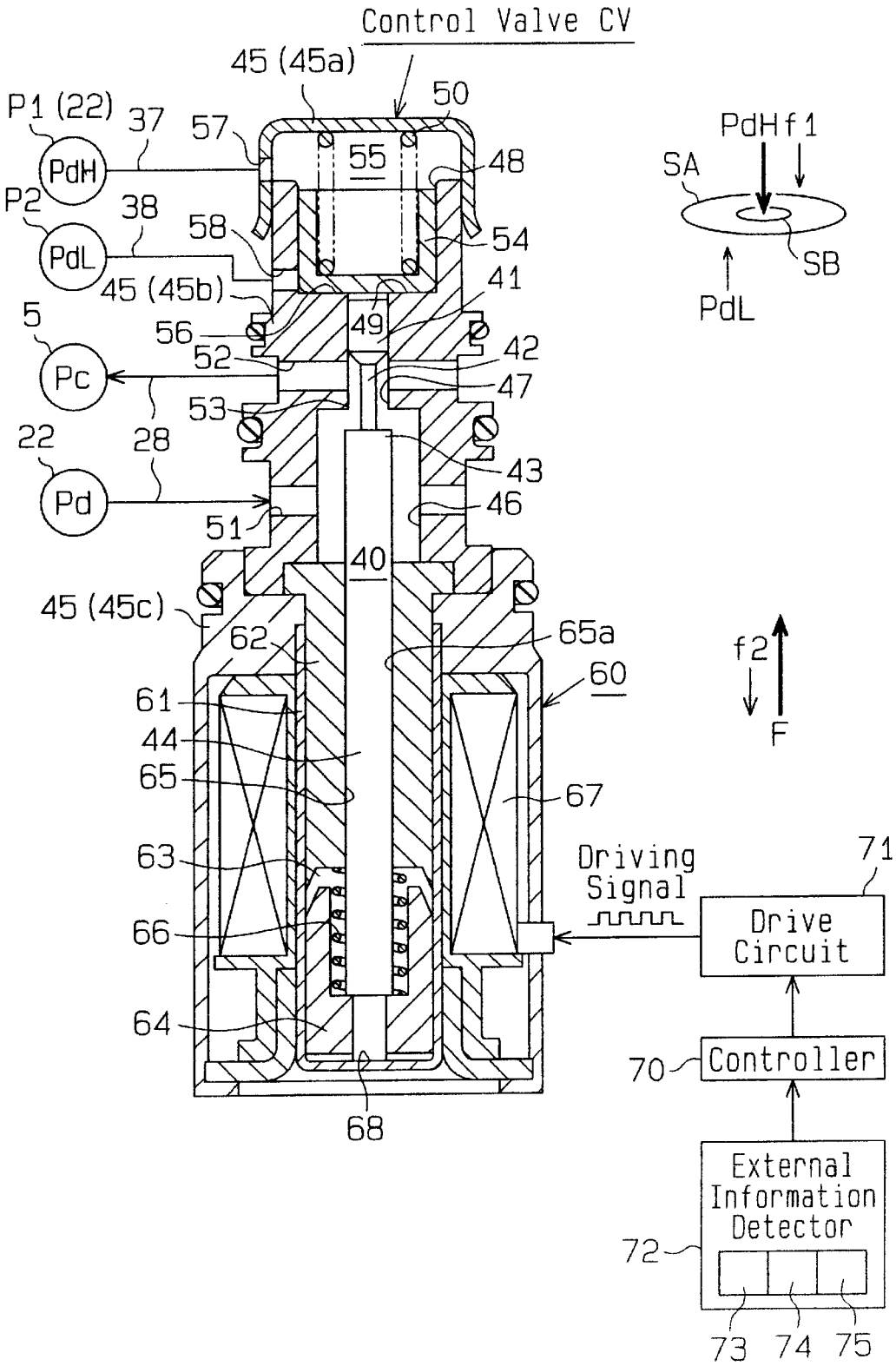
FIG. 3 is a cross-sectional view of the control valve.

As shown in FIG. 3, the control valve CV includes an input side valve section and a solenoid section 60. The input side valve section adjusts the degree of opening of the supply passage 28 connecting the discharge chamber 22 to the crank chamber 5. The solenoid section 60 is an electromagnetic actuator for applying force to an operating rod 40, which is arranged within the control valve CV, on the basis of external instructions. The operating rod 40 has a divider 41 at its upper end, a connecting section 42, a valve body 43, which is substantially at the center, and a base end, which serves as a guide rod 44. The valve body 43 forms a part of the guide rod 44.

The valve housing 45 of the control valve CV includes a cap 45*a*, an upper body 45*b*, which forms the outer contour of the input side valve body, and a lower body 45*c*, which forms the outer contour of the solenoid section 60. A valve chamber 46 and a communication passage 47 are located in the upper body 45*b* of the valve housing 45, and a pressure-sensitive chamber 48 is located between the upper body 45*b* and the cap 45*a*.

In the valve chamber 46 and the communication passage 47, the operating rod 40 is movable in the axial direction (in the vertical direction in the drawing). The valve chamber 46 and the communication passage 47 are connected in a certain position of the operating rod 40. The communication passage 47 and the pressure-sensitive chamber 48 are separated by the divider 41 of the operating rod 40.

A bottom wall of the valve chamber 46 is provided by the upper end of a fixed iron core 62. A radial port 51 is provided on the peripheral wall of the valve housing 45 surrounding the valve chamber 46. This port 51 connects the valve chamber 46 with the discharge chamber 22 via an upstream portion of the supply passage 28. A radial port 52 is located also on the peripheral wall of the valve housing 45. This radial port 52 connects the communication passage 47 with the crank chamber 5 via the downstream portion of the supply passage 28. Therefore, the port 51, the valve chamber 46, the communication passage 47 and the port 52 from a part of the supply passage 28 connecting the discharge chamber 22 and the crank chamber 5 with each other within the control valve.

The valve body 43 of the operating rod 40 is arranged in the valve chamber 46. The diameter of the communication passage 47 is greater than that of the connecting section 42 of the operating rod 40 and smaller than the diameter of the guide rod 44. In other words, the area of the communication passage 47 (area in a plane perpendicular to the axis of the divider 41) SB is larger than the area of the connecting section 42 and smaller than the area of the guide rod 44. As a result, a step located at the boundary between the valve chamber 46 and the communication passage 47 serves as a valve seat 53, and the communication passage 47 plays the role of a valve hole.

Figure 4A:
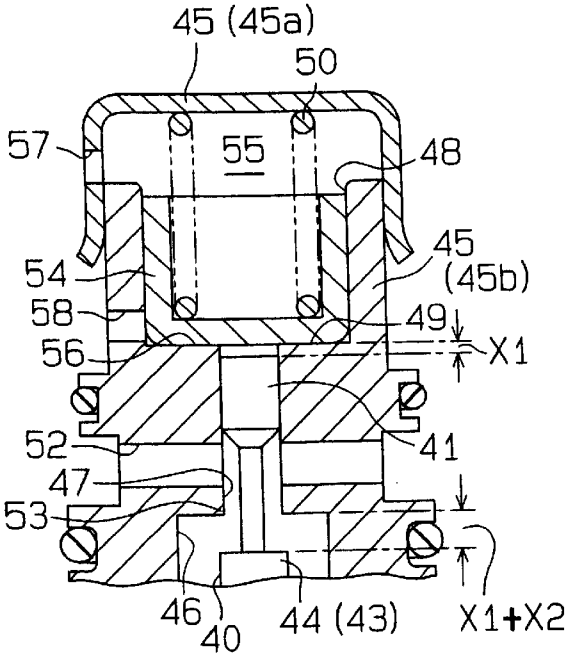
FIGS. 4(*a*)–(*c*) are partial, enlarged cross sectional views illustrating operation of the control valve.
Figure 4B:
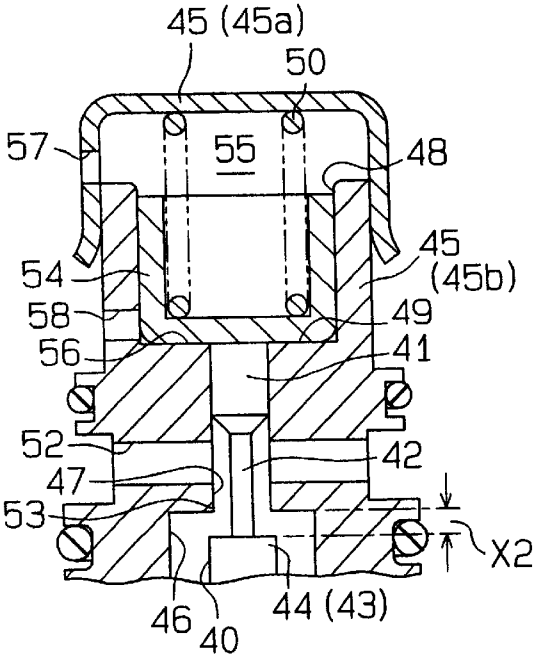
Figure 4C:
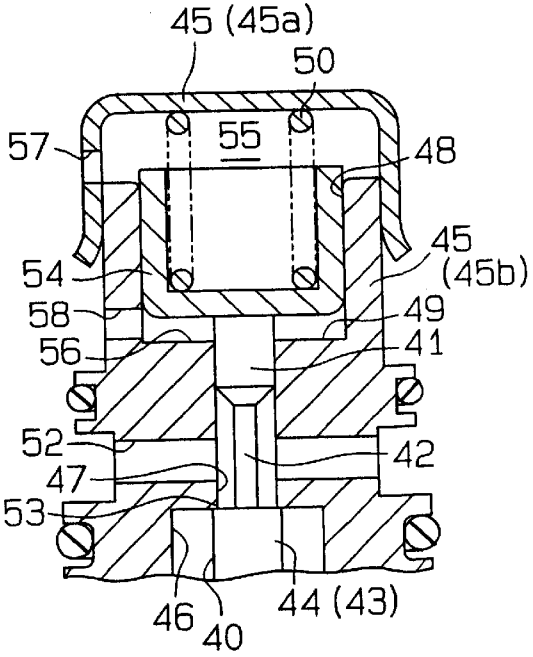

When the operating rod 40 moves up from the position (the lowermost position) shown in FIGS. 3 and 4(*a*) to the position (the uppermost position) shown in FIG. 4(*c*) where the valve body 43 sits on the valve seat 53, the communication passage 47 is closed. That is, the valve body 43 of the operating rod 40 serves as an input side valve body that controls the opening of the supply passage 28.

A pressure-sensitive member 54 is movable in the axial direction in the pressure-sensitive chamber 48. The pressure-sensitive member 54 is cylindrical and has a bottom. The pressure-sensitive member 54 divides the pressure-sensitive chamber 48 in the axial direction into a P1 pressure chamber (first pressure chamber) 55 and a P2 pressure chamber (second pressure chamber) 56 (In FIGS. 3, 4(*a*) and 4(*b*), the P2 pressure chamber 56 has a volume of substantially zero). The pressure-sensitive member 54 serves as a divider between the P1 pressure chamber 55 and the P2 pressure chamber 56 and does not allow direct communication between the pressure chambers 55 and 56. The cross sectional area perpendicular to the axis of the pressure-sensitive member 54 SA is larger than the bore area SB of the communication passage 47.

Movement of the pressure-sensitive member 54 to the P2 pressure chamber 56 side is limited by contact with the bottom surface of the P2 pressure chamber 56. That is, the bottom surface of the P2 pressure chamber 56 forms a pressure-sensitive member regulating section 49. A pressure-sensitive member urging spring 50 applies force to the pressure-sensitive member. The pressure-sensitive member urging spring 50 urges the pressure-sensitive member 54 from the P1 pressure chamber 55 toward the P2 pressure chamber 56, i.e., toward the pressure-sensitive member regulating section 49.

The P1 pressure chamber 55 communicates with the discharge chamber 22 at the first pressure monitoring point P1 via the P1 port 57 formed on the cap 45*a* and the first pressure detecting passage 37. The P2 pressure chamber 56 communicates with the second pressure monitoring point P2 via the P2 port 58 formed on the cap 45*a* of the valve housing 45 and the second pressure detecting passage 38. That is, the discharge pressure Pd is applied as high pressure PdH to the P1 pressure chamber 55, and a low pressure PdL of the pressure monitoring point P2 is applied to the P2 pressure chamber 56.

The solenoid section 60 has a cylindrical housing cylinder 61 with a bottom. A fixed iron core 62 is engaged with the top of the housing cylinder. This engagement divides a solenoid chamber 63 in the housing cylinder 61. A movable iron core 64 is located in the axial direction in the solenoid chamber 63. An axial guide hole 65 is formed at the center of the fixed inner core 62. A guide rod 44 of the operating rod 40 is located in the guide hole 65 and moves axially.

The solenoid chamber 63 accommodates the base portion of the operating rod 40. In other words, the lower end of the guide rod 44 is engaged with a hole in the center of the movable iron core 64 in the solenoid chamber 63, and fixed by crimping. The movable iron core 64 and the operating rod 40 therefore move integrally.

The lower end of the guide rod 44 slightly projects from the lower surface of the movable iron core 64. Downward movement of the operating rod 40 (valve body 43) is regulated by contact between the lower end surface of the guide rod 44 and the bottom surface of the solenoid chamber 63. That is, the bottom surface of the solenoid chamber 63 serves as a valve body regulating section 68, and the valve body regulating section 68 limits the degree of opening of the communication passage 47.

A valve body urging spring 66 is accommodated between the fixed iron core 62 and the movable iron core 64 in the solenoid chamber 63. The valve body urging spring 66 separates the movable iron core 64 from the fixed iron core 62 and imparts a force to the operating rod 40 (valve body 43) toward the bottom of the drawing, i.e., toward the valve body regulating section 68.

As shown in FIGS. 3 and 4(*a*), at the lowermost position where the operating rod 40 is regulated by the valve body regulating section 68, the valve body 43 is spaced apart from the valve seat 53 by a distance X1+X2, which results in the maximum degree of opening of the communication passage 47. In this state, the divider 41 of the operating rod 40 enters the communication passage 47 by a distance X1 relative to the pressure-sensitive chamber 48. Therefore, the upper end of the divider 41 and the lower surface of the pressure-sensitive member 54, which is in contact with the pressure-sensitive member regulating section 49, are spaced apart from each other by a distance X1.

A coil 67 is wound about the iron cores 62 and 64. A driving signal is issued from the drive circuit 71 to the coil 67 on the basis of an instruction from a controller 70. The coil 67 produces of an electromagnetic attraction force (electromagnetically force) F between the movable iron core 64 and the fixed iron core 62. The magnitude of the force F depends on the level of the electric current applied to the coil 67. Energization of the coil 67 is accomplished by adjusting the voltage applied to the coil 67. In this embodiment, duty control is adopted for the adjustment of the voltage to be impressed.

(Operating Properties of Control Valve)

In the control valve CV, the position of the operating rod 40, i.e., the degree of opening of the valve, is determined as follows. The effect of the inner pressure of the valve chamber 46, the communication passage 47 and the solenoid chamber 63 on the position of the operating rod 40 shall be disregarded.

First, as shown in FIGS. 3 and 4(*a*), if the coil 67 not energized (Dt=0%), the action of the downward force f2 of the valve body urging spring 66 is dominant in positioning the operating rod 40. The operating rod 40 is therefore located at the lowermost position and is pressed against the valve body regulating section 68 with the force f2 of the valve body urging spring 66. In this state, even when, for example, the compressor (control valve CV) is vibrated by vibration of the vehicle, the size of the components and the integral assembly of the operating rod 40 and the movable iron core 64 are such that vibration is inhibited.

In this state, the valve body 43 of the operating rod 40 is spaced from the valve seat 53 by a distance X1+X2, and the communication passage 47 is fully open. The crank pressure Pc is thus maximized. Because the difference between the crank pressure Pc and the inner pressure of the cylinder bore is very large, the inclination angle of the swash plate 12 is minimized and the displacement of the compressor is minimized.

When the operating rod 40 is at the lowermost position, as described above, the operating rod 40 (divider 41) and the pressure-sensitive member 54 are disengaged. In positioning the pressure-sensitive member 54, therefore, the total load of the downward force based on the pressure difference ΔPd between two points (PdH·SA−PdL(SA−SB)) and the downward force f1 of the pressure-sensitive member urging spring 50 is dominant. The pressure-sensitive member 54 is pressed against the pressure-sensitive member regulating section 49 under this total load. At this point, the force f1 (f1=set load f1') of the pressure-sensitive member is sufficiently large to prevent vibration by pressing the pressure-sensitive member 54 against the pressure-sensitive member regulating section 49 even when the compressor (control valve) is exposed to vibration of the vehicle.

In the state shown in FIGS. 3 and 4(*a*), when the coil 67 is energized at the minimum duty ratio Dt(min)(Dt(min)>0) within a variable range of duty ratios, the upward electromagnetic force F becomes greater than the downward force f2 (f2=f2'), and the operating rod 40 starts upward movement.

Figure 5:
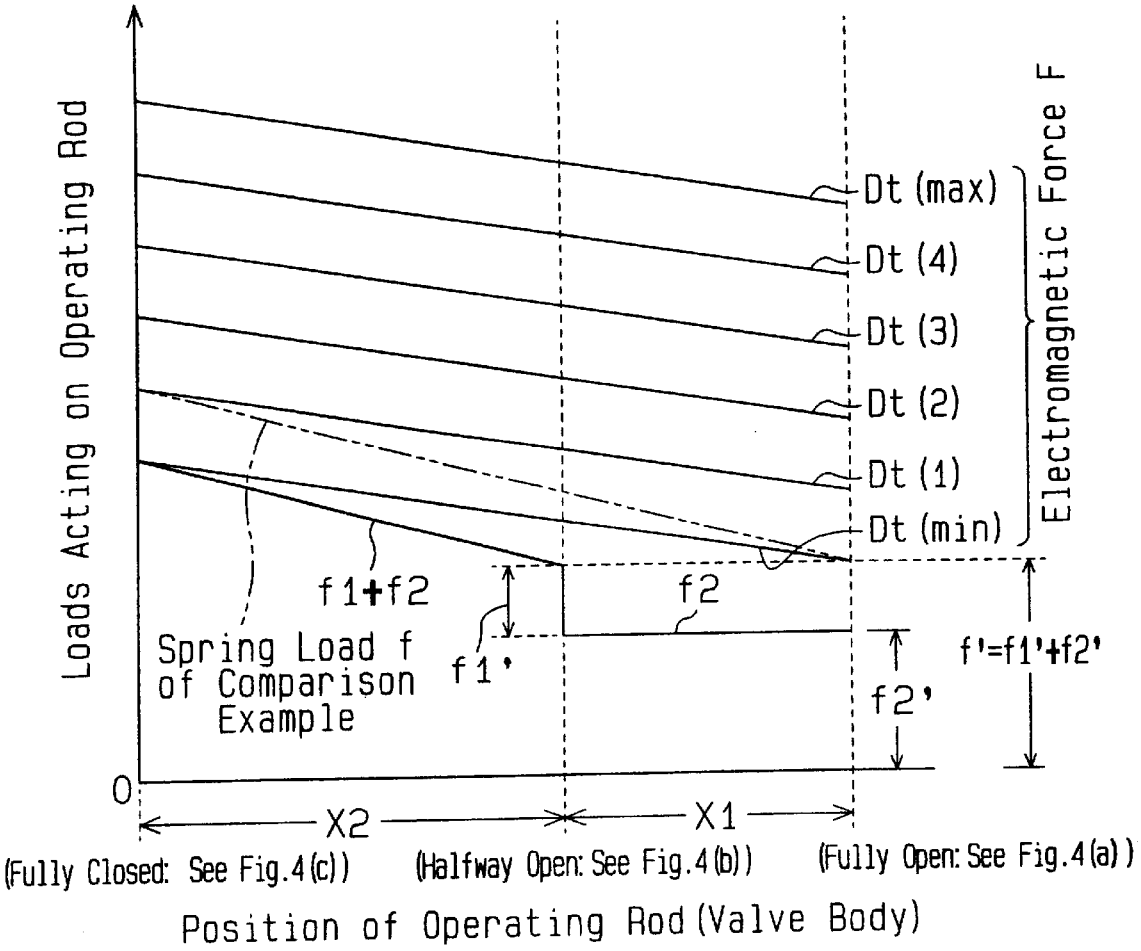
FIG. 5 is a graph illustrating various loads acting on the operating rod.

The graph of FIG. 5 illustrates the relationship between the position of the operating rod 40 (valve body 43) and various loads affecting the operating rod 40. The graph shows that, as the energizing duty ratio Dt to the coil 67 increases, the electromagnetic force F acting on the operating rod 40 increases. It is known from this graph that, when the operating rod 40 moves to close the valve, the movable iron core 64 approaches the fixed iron core 62, and this increases the electromagnetic force F acting on the operating rod 40, even with the same energizing duty ratio Dt applied to the coil 67.

The energizing duty ratio Dt to the coil 67 is continuously variable within a variable range from the minimum duty ratio Dt (min) to the maximum duty ratio Dt (max) (for example, 100%). The graph of FIG. 5 shows, however, only cases of Dt (min), Dt(1) to Dt(4) and Dt (max) for easier understanding.

As is clear from the inclination of the characteristic curves f1+f2 and f2 in the graph of FIG. 5, the valve body urging spring 66 has a spring constant far lower than that of the pressure-sensitive member urging spring 50. The spring constant of the valve body urging spring 66 is so low that the force f2 acting on the operating rod 40 is substantially the same as the set load f2' regardless of the distance between the fixed iron core 62 and the movable iron core 64 (representing the state of compression of the valve body urging spring 66).

When the coil 67 is energized with the minimum duty ratio Dt (min) in this state, the operating rod 40 moves to close the valve from the lowermost position by at least the distance X1, and the divider 41 (operating rod 40) engages with the pressure-sensitive member 54.

When the operating rod 40 and the pressure-sensitive member 54 engage with each other, the upward electromagnetic force F, which is countered by the downward force f2 of the valve body urging spring 66, opposes the downward force based on the pressure difference ΔPd between two points. The downward force f1 of the pressure-sensitive member urging spring 50 also applies downward force to the rod 40.

$$PdH \cdot SA - PdL(SA - SB) = F - f1 - f2 \quad \text{(Formula 1)}$$

Therefore, positioning of the valve body 43 is accomplished to satisfy the above formula, between the state shown in FIG. 4(*b*) and the state shown in FIG. 4(*c*) relative to the valve seat 53, and the degree of opening of the control valve CV is determined between an intermediate degree of opening (FIG. 4(*b*)) and full opening (FIG. 4(*c*)). Therefore, the displacement of the compressor is changed within a range from the minimum to the maximum.

For example, when the number of revolutions of the engine E decreases and the refrigerant flow rate of the refrigerant circulation circuit decreases, the downward pressure difference ΔPd between the two points decreases. At this point, with an electromagnetic force F, it is impossible to balance the upward and downward forces acting on the operating rod 40. Therefore, movement of the operating rod 40 causes the pressure-sensitive member urging spring 50 to compress. The valve body 43 of the operating rod 40 is positioned where the change in the downward force f1 of the pressure-sensitive member urging spring 50 compensates for the change in the force produced by the pressure difference ΔPd between the two points. As a result, the degree of opening of the communication passage 47 decreases, and the crank pressure Pc decreases. The difference between this crank pressure Pc and the inner pressure of the cylinder bore 1*a* via the piston 20 decreases. The inclination of the swash plate 12 increases, and the displacement of the compressor increases. Increase in the displacement of the compressor increases in the refrigerant flow rate in the refrigerant circulation circuit, thus increasing the pressure difference ΔPd between two points.

When an increase in the number of revolutions of the engine E leads to an increase in the refrigerant flow rate of the refrigerant circulation circuit, the downward force based on the pressure difference ΔPd between the two points increases. At this time, it is impossible to balance the up and down forces acting on the operating rod 40 with an electromagnetic force F. The operating rod 40 therefore moves downward. The pressure-sensitive member urging spring 50 expands. The valve body 43 of the operating rod is positioned such that the change in the downward force f1 of the pressure-sensitive member urging spring 50 compensates for the change in the downward force based on the pressure difference ΔPd between the two points. As a result, the degree of opening of the communication passage 47 increases, and the crank pressure Pc increases. The difference between the crank pressure Pc and the inner pressure of the cylinder bore 1*a* via the piston 20 increases. The inclination of the swash plate 12 accordingly decreases, and the displacement of the compressor is reduced. When the displacement of the compressor decreases, the refrigerant flow rate in the refrigerant circulation circuit also decreases, which decreases the pressure difference ΔPd between the two points.

When a larger energizing duty ratio Dt to the coil 67 is selected, the electromagnetic force F increases, and the upward and downward forces cannot be balanced at this point. The operating rod 40 therefore moves upward to compress the pressure-sensitive member urging spring 50. The valve body 43 of the operating rod 40 is positioned such that the change in the downward force f1 of the pressure-sensitive member urging spring 50 compensates for the change in the upward electromagnetic force F. Therefore, the degree of opening of the control valve CV, i.e., the degree of opening of the communication passage 47, decreases, and the displacement of the compressor is increased. As a result, the refrigerant flow rate in the refrigerant circulation circuit increases, which increases the pressure difference ΔPd between the two points.

When the energizing duty ratio Dt to the coil 67 is reduced, and the electromagnetic force F is decreased the up and down forces cannot be balanced with the force based on the pressure difference ΔPd between the two points at this point. The operating rod 40 therefore moves down, which expands the pressure-sensitive member urging spring 50. The valve body 43 of the operating rod 40 is positioned such that the change in the downward force f1 of the pressure-sensitive member urging spring 50 compensates for the change in the upward electromagnetic force F. The degree of opening of the communication passage 47 increases, and the displacement of the compressor decreases. As a result, the refrigerant flow rate in the refrigerant circulation circuit decreases, which decreases the pressure difference ΔPd between the two points.

When the coil 67 is energized with a duty ratio Dt larger than the minimum one (Dt (min)), the control valve CV automatically positions the operating rod 40 in response to a variation of the pressure difference ΔPd between the two points to maintain a control target (set pressure difference) of the pressure difference ΔPd between the two points determined by the electromagnetic force F. This set pressure difference is variable between the minimum duty ratio (Dt (min)) and the maximum duty ratio (Dt (max)) by changing the electromagnetic force F.

(Control System)

As shown in FIGS. 2 and 3, an air conditioner for vehicle has a controller 70 governing overall control of the air conditioner. The controller 70 is a control unit similar to a computer having a CPU, a ROM, a RAM and an I/O interface. An external information detector 72 is connected to an input terminal of the I/O interface, and a drive circuit 71 is connected to an output terminal of the I/O interface.

The controller 70 calculates an appropriate duty ratio Dt on the basis of various pieces of external information provided by the external information detector 72 and instructs the drive circuit 71 to issue a driving signal of the calculated duty ratio Dt. The drive circuit 71 outputs a driving signal of the instructed duty ratio Dt to the coil 67 of the control valve CV. The electromagnetic force F of the solenoid section 60 of the control valve CV varies in response to the duty ratio of the driving signal.

The external information detector 72 includes various sensors. Sensors forming the external information detector 72 include, for example, an A/C switch 73 (ON/OFF switch of an air conditioner operated by a passenger), a temperature sensor 74 for detecting temperature Te(t) in the vehicle, and a temperature setter 75 for setting a set temperature Te(set).

Figure 6:
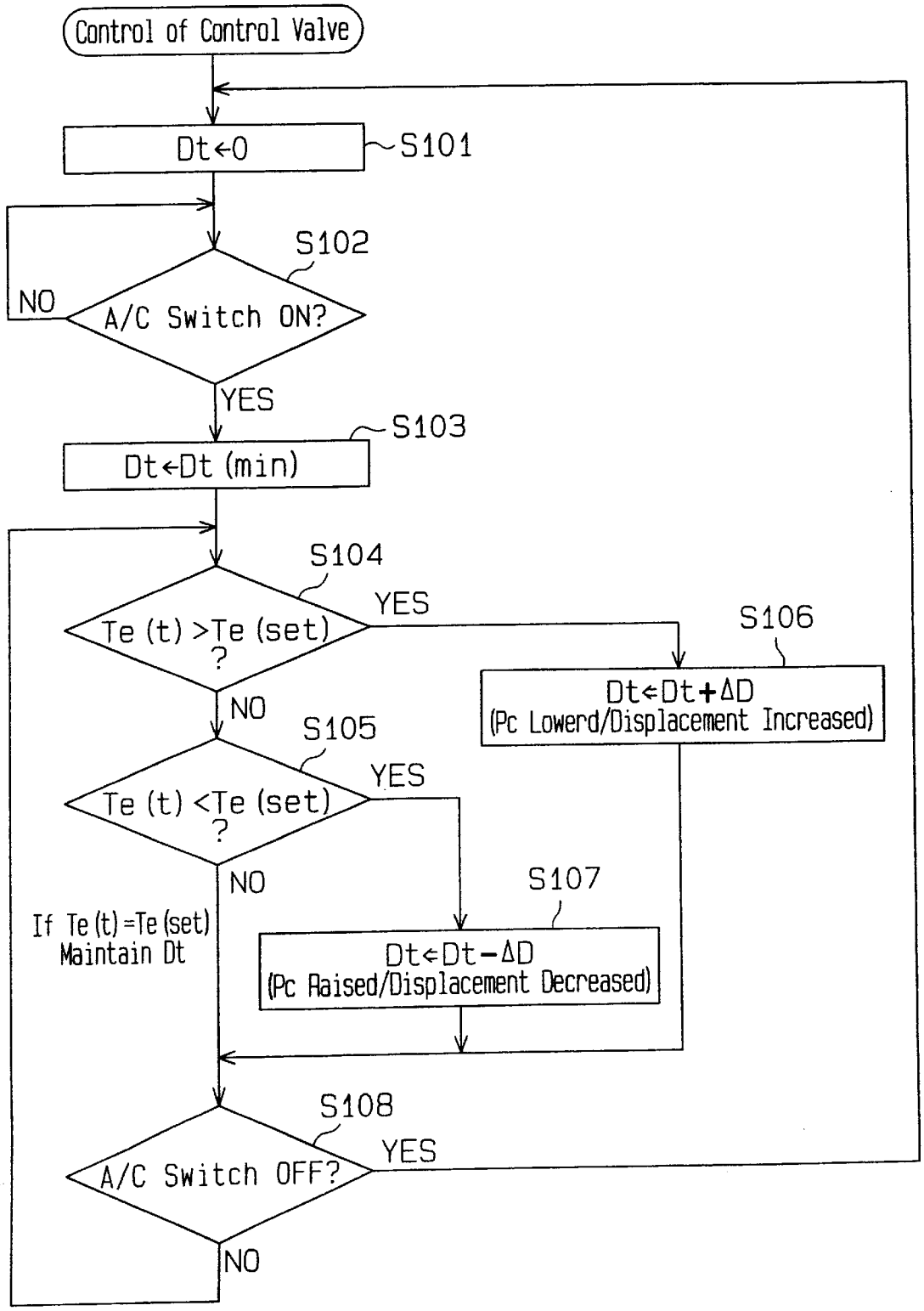
FIG. 6 is a flowchart illustrating a procedure for controlling the control valve.

An outline of the duty control for the control valve CV by the controller 70 will now be briefly described with reference to the flowchart shown in FIG. 6.

When the ignition switch (or the starting switch) of the vehicle is turned on, the controller 70 is powered and starts processing. The controller 70 performs various initialization step in accordance with initial programs in step 101 (hereinafter simply referred to as S101, the same applies to the other steps hereafter). For example, an initial value of zero (non-energized state) is given to the duty ratio Dt for the control valve CV. Subsequently, processing proceeds to status monitoring and calculation of duty ratio shown in S102 and subsequent steps.

In S102, the ON/OFF state of the A/C switch 73 is monitored until and a switch 73 is turned on. When the A/C switch 73 is turned on, the minimum duty ratio Dt (min) is set for the duty ratio Dt of the control valve CV in S103, and the self-control function (set pressure difference maintaining function) of the control valve CV is started.

In S104, the controller 70 determines whether or not the detected temperature Te(t) of the temperature sensor 74 is larger than the set temperature Te(set) set by the temperature setter 75. When NO is determined in S104, it is determined whether or not the detected temperature Te(t) is lower than the temperature Te(set) in S105. When the answer is NO in S105, the detected temperature Te(t) agrees with the set temperature Te(set) and is not necessary to change the duty ratio Dt. Therefore, the controller 70 does not change the duty ratio Dt to the drive circuit 71, and the process proceeds to S108.

When the answer is YES in S104, the vehicle interior space is predicted to be hot, leading to a large thermal load. In S106, the controller 70 causes the duty ratio Dt to be increased by a unit quantity ΔD, and instructs the drive circuit 71 to change the duty ratio Dt to a corrected value (Dt+ΔD). The degree of opening of the control valve CV slightly decreases, which increases the displacement of the compressor and increases the heat removing ability of the evaporator 33. The temperature Te(t) is decreased, accordingly.

When the determination is YES in S105, the car interior is assumed to be cold and the thermal load is assumed to be small. In S107, therefore, the controller 70 decreases the duty ratio Dt by a unit quantity ΔD and instructs the drive circuit 71 to change the duty ratio to a corrected value (Dt−ΔD). The degree of opening of the control valve CV increases slightly. The displacement of the compressor decreases, which reduces heat removing ability of the evaporator 33. The temperature Te(t) is increased, accordingly.

In S108, it is determined whether or not the A/C switch 73 has been turned off. If the answer is No, the process advances to S104. If S108 results in a determination of YES, step S101 is performed, and the control valve CV is de-energized. The control valve CV is fully opened. More specifically, the supply passage 28 is opened more than halfway to raise the pressure in the crank chamber 5 as rapidly as possible. As a result, it is possible to minimize the discharge of the compressor in response to the shut off of the A/C switch 73 and to reduce the period in which an unnecessary amount of refrigerant flows through the refrigerant circulation circuit.

Particularly in a clutchless compressor when the engine E is being started, it is not necessary to cool (in an OFF-state of the A/C switch 73), and the displacement must be minimized to reduce the power loss of the engine E. With a view to satisfy this demand also, it is important to use the control valve CV, which increases the degree of opening more than halfway minimize the displacement.

As described above, by correcting of the duty ratio Dt in S106 and/or S107, the duty ratio Dt is gradually optimized even when the detected temperature Te(t) deviates from the set temperature Te(set), and furthermore, together with the automatic adjustment of the degree of valve opening, the temperature Te(t) converges to the set temperature Te(set).

According to this embodiment, the following advantages are achieved.

(1) In this embodiment, feedback control of the displacement of the compressor is achieved by directly controlling the pressure difference ΔPd between two pressure monitoring points P1 and P2 in the refrigerant circulation circuit for control of the control valve CV, without using the suction pressure Ps, which is affected by the magnitude of the thermal load on the evaporator 33. It is thus possible to responsively and externally control the displacement, and the thermal load on the evaporator 33 has almost no effect on the control procedure.

(2) By use of the springs 50 and 66 and the regulating sections 49 and 68, the control valve CV is substantially vibration proof. It is therefore possible to avoid problems such as damage to the movable parts 40, 54 and 60 due to impact with fixed members (such as the valve housing 45, or the like) caused by vibration of the vehicle.

(3) In the control valve CV, movement of the operating rod 40 (valve body 43) is limited by the valve body regulating section 68, and movement of the pressure-sensitive member 54 is limited by the pressure-sensitive member regulating section 49. This occurs when the operating rod 40 and the pressure-sensitive member 54 are separated. From another point of view, as described in (2) above, the two springs 50 and 66 and the two regulating sections 49 and 68 are provided because the movable parts 40, 54 and 60 are separated when the coil 67 is de-energized.

For comparison purposes, consider a control valve in which the operating rod 40 and the pressure-sensitive member 54 are integrated. In such a control valve, pressing either the operating rod 40 or the pressure-sensitive member 54 against the regulating section is to press the other indirectly against the corresponding regulating section. Therefore, it suffices to provide only one spring and one regulating section.

However, as shown by a broken line in the graph of FIG. 5, a single spring used in the control valve of the comparative valve requires a large set load f' (f'=f1'+f2') sufficient to hold the total weight of the movable parts 40, 54 and 60 against the regulating section for protecting against vibration. It is necessary to use a spring having a large spring constant in which the characteristic curve f inclines more than the characteristic curve of the electromagnetic force F, for permitting positioning of the operating rod 40 at any position within a range from halfway open to fully open, as is clear from formula 2 (described later) That is, unless the characteristic curve f of the spring is inclined more than the characteristic curve of the electromagnetic force F, the spring cannot compensate for a change in the electromagnetic force F with an equivalent change even by displacement of the operating rod 40 (i.e., by changing in the compression of the spring). This is also the case with the pressure-sensitive member urging spring 50.

$$PdH \cdot SA - PdL(SA - SB) = F - f \quad \text{(Formula 2)}$$

In the control valve of the comparative case, even when the electromagnetic force F becomes larger than the spring initial load f' beyond the minimum duty ratio Dt (min) as in the present embodiment, to start the inner self-controlling function by achieving the medium degree of opening by overcoming the increasing spring force f according as the operating rod 40 is moved upward more, it is necessary to increase the duty ratio Dt to Dt(1). From among the duty ratios up to the maximum Dt(max), the range of up to Dt(1)

is consumed for starting the inner self-controlling function. Therefore, change in the set pressure difference serving as a criterion for the inner self-controlling operations is possible only by using a duty ratio Dt within a tight range of from Dt(1) to Dt(max), thus reducing the range of variation of the set pressure difference.

More specifically, in the control valve of the comparative valve, protecting against vibration of the movable parts 40, 54 and 60 and permitting self-control on the basis of pressure difference ΔPd between the two points are accomplished with use of a single spring. Therefore, the force f applied by the spring to the operating rod 40 is higher than the spring force f1+f2 in the present embodiment. As a result, with the maximum duty ratio Dt(max), the pressure difference ΔPd between the two points satisfying the formula 2 becomes smaller, and this lowers the maximum controllable flow rate of the refrigerant circulation circuit with the maximum set pressure difference.

On the other hand, assume that the pressure sensing configuration of the pressure difference ΔPd between the two points, i.e., the force applied to the operating rod 40 based on the pressure difference ΔPd, is decrease to increase the maximum set pressure difference in the control valve of the comparative valve. For example, the left side of formula 2 PdH·SA−PdL(SA−SB) is reduced by reducing the cross sectional area of the divider 41. However, when the duty ratio is the minimum Dt(1), the pressure difference ΔPd between the two points satisfying formula 2 is too large, thus increasing the minimum set pressure difference, i.e., the controllable minimum flow rate of the refrigerant circulation circuit.

In the control valve CV of this embodiment, however, when the coil 67 is de-energized, the movable parts 40, 54 and 60 are separated, and for each of these separated movable parts, 40, 54 and 60, springs 50, 66 and regulating sections 49 and 68 are provided to protect against vibration. A role of the spring means having a large spring constant necessary for achieving inner self-control is therefore to cause the expanding/contracting pressure-sensitive members to be in charge of a narrow range from medium to full opening (that is only within a range necessary to inner self-control), and cause the valve body urging spring 66, which must cover a wide range from full closing to full opening, to have the lowest possible spring constant.

As a result, the spring imparting force (f1+f2) acting on the operating rod 40 could be set to a value smaller than (f) in the comparative valve while protecting against vibration of the movable parts 40, 54 and 60, and it is possible to satisfy formula 1 with an electromagnetic force F smaller than in the comparative valve. It is therefore possible to make a change in set pressure difference having a wide variable range by use of a duty ratio Dt(min) to Dt(max) selected from a wider range, hence refrigerant flow rate control of the refrigerant circulation circuit.

(4) Until the operating rod 40 (valve body 43) engages the pressure-sensitive member 54, the pressure-sensitive member 54 is pressed by the pressure-sensitive member urging spring 50 against the pressure-sensitive member regulating section 49. In other words, the pressure-sensitive member 54 is stationary as long as it is not necessary to reflect the pressure difference ΔPd between the two points for positioning the operating rod 40. The pressure-sensitive member 54 is never moved unnecessarily, as in the comparative valve (full opening ←→medium opening), and the durability of the pressure-sensitive member 54 and the control valve CV is improved.

(5) In a vehicle air conditioner, which is arranged in a narrow engine room of the vehicle, there are limitations on the shape and size of the compressor. Thus, there are limits on the shape and size of the control valve CV and the solenoid section 60 (coil 67). A car-mounted battery is used as the power source of the solenoid section 60, and the voltage of the car battery is regulated to 12 to 24 V.

In the aforementioned comparative valve, if to increase the maximum electromagnetic force F capable of being produced by the solenoid section 60 to expand the variable range of set pressure differences, increasing the size of the coil 67 or using a higher voltage are almost impossible because large-scale changes in existing peripheral devices would be required. In other words, in the control valve CV of a compressor used in a vehicle air conditioner, when an electromagnetic actuator configuration is used as an external control device, the most suitable way to expand the variable range of set pressure difference, is shown by this embodiment, which does not require increasing the size of the control valve CV or a higher voltage.

(6) The pressure-sensitive member urging spring 50 imparts a force on the pressure-sensitive member 54 from the P1 pressure chamber 55 toward the P2 pressure chamber 56. That is, the acting direction of the force of the pressure-sensitive member urging spring 50 to the pressure-sensitive member 54 coincides with the acting direction of the force based on the pressure difference ΔPd between the two points. Therefore when the coil 67 is de-energized, the pressure-sensitive member 54 is pressed against the pressure-sensitive member regulating section 49 by the force based on the pressure difference ΔPd between the two points.

(7) The control valve CV changes in the pressure of the crank chamber 5 by so-called input side control, which changes the degree of opening of the supply passage 28. As compared with the so-called output side control, which changes the degree of opening of the bleeding passage 27, for example, a change in the pressure of the crank chamber 5, i.e., a change in the displacement of the compressor, is rapid as a result of the use of high pressure. This improves air conditioning.

(8) The first and second pressure monitoring points P1 and P2 are set in the refrigerant path between the discharge chamber 22 and the condenser 31 of the compressor. It is therefore possible to prevent the effect of operation of the expansion valve 32 from causing a disturbance in obtaining information of the displacement of the compressor, depending upon the pressure difference ΔPd between two points.

Insofar as the purposes of the present invention are not defeated, the invention can be modified.

It should be apparent to those skilled in the art that the present invention may be embodied in many other specific forms without departing from the spirit of scope of the invention. Particularly, it should be understood that the invention may be embodied in the following forms.

The first pressure monitoring point P1 can be in the suction pressure area between the evaporator 33 and the suction chamber 21 and the second pressure monitoring point P2 can be in downstream of the first pressure monitoring point P1 in the same suction pressure area. This embodiment has advantages similar to those of the above-mentioned embodiments.

The first pressure monitoring point P1 may be located in the discharge pressure area between the discharge chamber 22 and the condenser 31, and the second pressure monitoring point P2 may be located in the suction pressure area between the evaporator 33 and the suction chamber 21.

The discharge pressure area may be located between the discharge chamber 22 and the condenser 31, and the second pressure monitoring point P2 may be located in the crank chamber 5. Alternatively, the first pressure monitoring point P1 may be located in the crank chamber 5, and the second pressure monitoring point P2 may be located in the suction pressure area between the evaporator 33 and the suction chamber 21. That is, the pressure monitoring points P1 and P2 may form a sequence of the refrigerant circuit, which is the main circuit of the refrigerant circulation circuit (external refrigerant circuit 30 (evaporator 33)→suction chamber 21→cylinder bore 1*a*→discharge chamber 22→external refrigerant circuit 30 (condenser 31)). More specifically, the sequence is not limited to the high pressure area and/or low pressure area of the refrigerant circuit, but setting may be made in the intermediate pressure area forming the refrigerant circuit (supply passage 28→crank chamber 5→bleeding passage 27) for displacement control.

The control valve CV may be a so called output side control valve adjusting the crank pressure Pc through that adjusts of the bleeding passage 27 instead of the supply passage 28.

The valve opening of the control valve CV may be increased as the electromagnetic force F of the solenoid section 60 is increased. That is, the set pressure difference may be increased as the electromagnetic force is increased.

The valve body urging spring 66 may be accommodated in the valve chamber 46 instead of in the solenoid chamber 63.

The present invention may be embodied in a controller of a wobble type variable displacement compressor.

A mechanism that has a clutch mechanism such as an electromagnetic clutch may be used as the power transmission mechanism PT. When the load on the engine is great, for example, when the vehicle is accelerating, all available engine power needs to be used for moving the vehicle. Under such conditions, to reduce the engine load, the compressor displacement is minimized. This is referred to as a displacement limiting control procedure. Performing the displacement limiting control procedure by minimizing the compressor displacement generates smaller shock than performing the procedure by disengaging an electromagnetic clutch and thus does not disturb passengers. Therefore, even if a compressor has a clutch, the displacement limiting control procedure is preferably performed by minimizing the compressor displacement. Since the opening size can be greater than the halfway open state, which minimizes the compressor displacement, the control valve CV of the present invention is suitable for a compressor that has a clutch.

Therefore, the present examples and embodiments are to be considered as illustrative and not restrictive and the invention is not to be limited to the details given herein, but may be modified within the scope and equivalence of the appended claims.

What is claimed is:

1. A control valve used in a variable displacement compressor, wherein the compressor draws refrigerant from an external refrigerant circuit, compresses the refrigerant and then discharges the compressed refrigerant to the external refrigerant circuit, wherein a zone that is exposed to suction pressure is connected to a crank chamber by a bleeding passage, and a zone that is exposed to discharge pressure is connected to the crank chamber by a supply passage, thereby adjusting the pressure in the crank chamber, wherein the displacement of the compressor is varied based on the pressure in the crank chamber, the control valve comprising:

a valve housing;

a valve chamber defined in the valve housing, the valve chamber forming a part of the supply passage or the bleeding passage;

a valve body accommodated in the valve chamber, wherein the valve body is moved in the valve chamber to adjust the degree of opening of the supply passage or the bleeding passage;

a first limiting member, wherein, when contacting the valve body, the first limiting member limits the movement of the valve body;

a first urging member for urging the valve body toward the first limiting member;

a pressure-sensitive chamber defined in the valve housing;

a pressure-sensitive member movably arranged in the pressure-sensitive chamber, wherein the pressure-sensitive member divides the pressure-sensitive chamber into a first pressure chamber and a second pressure chamber, wherein the pressure-sensitive member is moved based on the pressures in the first and second pressure chambers, and wherein the pressure-sensitive member selectively separates from and engages with the valve body;

first and second pressure monitoring points located in the external refrigerant circuit, the pressure difference between the two pressure monitoring points representing the compressor displacement, wherein the first pressure monitoring point is located in a higher pressure zone and the second pressure monitoring point is located in a lower pressure zone, wherein the first pressure chamber is exposed to the pressure at the first pressure monitoring point and the second pressure chamber is exposed to the pressure at the second pressure monitoring point, wherein, when the pressure-sensitive member is moved based on the pressure difference between the first and second pressure chambers, the movement of the pressure-sensitive member affects the position of the valve body such that the compressor displacement is changed to reduce fluctuations in the pressure difference between the first and second pressure chambers;

a second limiting member, wherein, when contacting the pressure-sensitive member, the second limiting member limits the movement of the pressure-sensitive member;

a second urging member for urging the pressure-sensitive member toward the second limiting member; and a control member, wherein the control member urges the valve body against the forces of the first and second urging members such that the valve body contacts the pressure-sensitive member, wherein the force applied to the valve body is externally controlled so that a set pressure difference, which is a reference value for determining the position of the valve body by the pressure-sensitive member, is changed.

2. The control valve according to claim 1, wherein each of the first urging member and the second urging member comprises a compression spring, and wherein the spring constant of the first urging member is lower than the spring constant of the second urging member.

3. The control valve according to claim 1, wherein the first urging member urges the pressure-sensitive member away from the first pressure chamber and toward the second pressure chamber.

4. The control valve according to claim 1, wherein the valve chamber forms a part of the supply passage.

5. The control valve according to claim 1, wherein the control member comprises an electromagnetic actuator in which the force applied to the valve body is changeable by electric control from outside.

6. The control valve according to claim 5, wherein the electromagnetic actuator is an electromagnetic solenoid and actuates the valve body based on a duty signal from outside.

7. A control valve used in a variable displacement compressor, wherein the compressor draws refrigerant from an external refrigerant circuit, compresses the refrigerant and then discharges the compressed refrigerant to the external refrigerant circuit, wherein a zone that is exposed to discharge pressure is connected to a crank chamber by a supply passage, thereby adjusting the pressure in the crank chamber, wherein the displacement of the compressor is varied based on the pressure in the crank chamber, the control valve comprising:

a valve housing;

a valve chamber defined in the valve housing, the valve chamber forming a part of the supply passage;

a valve body accommodated in the valve chamber, wherein the valve body is moved in the valve chamber to adjust the degree of opening of the supply passage;

a first limiting member, wherein, when contacting the valve body, the first limiting member limits the movement of the valve body;

a first spring member for urging the valve body toward the first limiting member;

a pressure-sensitive chamber defined in the valve housing;

a pressure-sensitive member movably arranged in the pressure-sensitive chamber, wherein the pressure-sensitive member divides the pressure-sensitive chamber into a first pressure chamber and a second pressure chamber, wherein the pressure-sensitive member is moved based on the pressures in the first and second pressure chambers, and wherein the pressure-sensitive member selectively separates from and engages with the valve body;

first and second pressure monitoring points located in the external refrigerant circuit, the pressure difference between the two pressure monitoring points representing the compressor displacement, wherein the first pressure monitoring point is located in a higher pressure zone and the second pressure monitoring point is located in a lower pressure zone, wherein the first pressure chamber is exposed to the pressure at the first pressure monitoring point and the second pressure chamber is exposed to the pressure at the second pressure monitoring point, wherein, when the pressure-sensitive member is moved based on the pressure difference between the first and second pressure chambers, the movement of the pressure-sensitive member affects the position of the valve body such that the compressor displacement is changed to reduce fluctuations in the pressure difference between the first and second pressure chambers;

a second limiting member, wherein, when contacting the pressure-sensitive member, the second limiting member limits the movement of the pressure-sensitive member;

a second spring member for urging the pressure-sensitive member toward the second limiting member, wherein the spring constant of the second spring member is higher than the spring constant of the first spring member; and an electromagnetic actuator, wherein the actuator urges the valve body against the forces of the first and second spring members such that the valve body contacts the pressure-sensitive member, wherein the force applied to the valve body is externally duty controlled so that a set pressure difference, which is a reference value for determining the position of the valve body by the pressure-sensitive member, is changed.

8. The control valve according to claim 7, wherein the first spring member urges the pressure-sensitive member away from the first pressure chamber and toward the second pressure chamber.

9. The control valve according to claim 7, wherein the electromagnetic actuator comprises a solenoid coil and a plunger, wherein the solenoid is excited and de-excited based on external duty control and the plunger that is moved when the solenoid coil is excited, and wherein the valve body forms a part of the plunger.

10. A control valve used in a variable displacement compressor, wherein the compressor is located in a refrigerant circuit and is connected to an evaporator and a condenser, wherein the compressor draws refrigerant from the evaporator, compresses the refrigerant and then discharges the compressed refrigerant to the condenser, wherein a zone that is exposed to discharge pressure is connected to a crank chamber by a supply passage, thereby adjusting the pressure in the crank chamber, wherein the displacement of the compressor is varied based on the pressure in the crank chamber, the control valve comprising:

a valve housing;

a valve chamber defined in the valve housing, the valve chamber forming a part of the supply passage;

a valve body accommodated in the valve chamber, wherein the valve body is moved in the valve chamber to adjust the degree of opening of the supply passage;

a first limiting member, wherein, when contacting the valve body, the first limiting member limits the movement of the valve body;

a first spring member for urging the valve body toward the first limiting member;

a pressure-sensitive chamber defined in the valve housing;

a pressure-sensitive member movably arranged in the pressure-sensitive chamber, wherein the pressure-sensitive member divides the pressure-sensitive chamber into a first pressure chamber and a second pressure chamber, wherein the pressure-sensitive member is moved based on the pressures in the first and second pressure chambers, and wherein the pressure-sensitive member selectively separates from and engages with the valve body;

a first pressure monitoring point located in a zone in the compressor that is exposed to the discharge pressure;

a second pressure monitoring point located between the compressor and the condenser, wherein the first pressure chamber is exposed to the pressure at the first pressure monitoring point and the second pressure chamber is exposed to the pressure at the second pressure monitoring point, and wherein the pressure difference between the two pressure monitoring points represents the compressor displacement, wherein, when the pressure-sensitive member is moved based on the pressure difference between the first and second pressure chambers, the movement of the pressure-sensitive member affects the position of the valve body such that the compressor displacement is changed to reduce fluctuations in the pressure difference between the first and second pressure chambers;

a second limiting member, wherein, when contacting the pressure-sensitive member, the second limiting member limits the movement of the pressure-sensitive member;

a second spring member for urging the pressure-sensitive member toward the second limiting member, wherein the spring constant of the second spring member is higher than the spring constant of the first spring member; and an electromagnetic actuator, wherein the actuator urges the valve body against the forces of the first and second spring members such that the valve body contacts the pressure-sensitive member, wherein the force applied to the valve body is externally duty controlled so that a set pressure difference, which is a reference value for determining the position of the valve body by the pressure-sensitive member, is changed.

* * * * *

UNITED STATES PATENT AND TRADEMARK OFFICE

CERTIFICATE OF CORRECTION

PATENT NO. : 6,447,258 B2
DATED : September 10, 2002
INVENTOR(S) : Ota et al.

It is certified that error appears in the above-identified patent and that said Letters Patent is hereby corrected as shown below:

Column 3,
Line 40, please delete “combination)” and insert therefore -- combination). --;

Column 12,
Line 49, please delete “later)” and insert therefore -- later). --.

Signed and Sealed this

Twenty-fifth Day of February, 2003

JAMES E. ROGAN
*Director of the United States Patent and Trademark Office*